United States Patent [19]

Simon

[11] 3,946,340

[45] Mar. 23, 1976

[54] PHASE SHIFTER

[75] Inventor: Joseph William Simon, Doraville, Ga.

[73] Assignee: Electromagnetic Sciences, Inc., Atlanta, Ga.

[22] Filed: Mar. 18, 1974

[21] Appl. No.: 452,457

[52] U.S. Cl. ..... 333/24.1; 333/98 R
[51] Int. Cl.[2] ..... H01P 1/40
[58] Field of Search ..... 333/24 G, 24.1, 24.2

[56] References Cited

UNITED STATES PATENTS

| | | | |
|---|---|---|---|
| 3,340,484 | 9/1967 | Siekanowicz et al. | 333/24.1 X |
| 3,401,361 | 9/1968 | Schloemann | 333/24.1 X |
| 3,445,790 | 5/1969 | Schneider | 333/24.1 |

*Primary Examiner*—Paul L. Gensler
*Attorney, Agent, or Firm*—Cushman, Darby & Cushman

[57] ABSTRACT

A latching ferrite phase shifter having a ferrite toroid is provided with inexpensive means for adjusting its magnetization to account for manufacturing inaccuracies and temperature changes. A small permanent magnet is mounted externally of the transmission line in which the ferrite is positioned. The permanent magnet applies parallel fields to the opposite sides of the toroid, selectively reducing magnetic flux density on one side.

3 Claims, 4 Drawing Figures

PHASE SHIFTER

The present invention relates to improvements in phase shifters which substantially reduce manufacturing costs and provide improved performance. More specifically the invention relates to the use of an external permanent magnet to compensate for manufacturing variations in the ferrimagnetic toroids in a phase shifter and/or to compensate for environmental temperature variations when the devices are used.

A phase shifter typically takes the form of a transmission line such as a waveguide or stripline having a ferrimagnetic toroid, usually a ferrite, longitudinally disposed therein with a conductor extending longitudinally through the toroid to carry a current which applies a magnetic field to the toroid. The magnetic field in the toroid alters the propagation constant of a wave propagating through the transmission line which in turn controls the phase shift. Latching phase shifters, which are the preferred type for application of the present invention, use a ferrimagnetic toroid having a square hysteresis loop, the phase shift depending on the remanent magnetic flux density B in the toroid and the length of the toroid. Typically, the toroids are cut to various lengths and several are provided which effect different phase shifts. For instance, four bit phase shifters have four toroids which effect phase shifts of 180°, 90°, 45° and 22.5° respectively. By selecting the direction of magnetization of the four toroids, it is possible to achieve phase shifts over 360° in increments of 22.5°. Assuming equal magnetizing currents and equal cross sections, the second, third and fourth toroids must be respectively 2, 4 and 8 times the length of the smallest to accurately achieve the desired phase shifts. Further information regarding these devices may be found in *Radar Handbook* by Merrill Shalnik (1970) Chapter 12.

In manufacturing phase shifters of this type, it is difficult to achieve absolute accuracy of the lengths of the respective toroids. Furthermore, manufacturing irregularities in the ferrimagnetic material from which the toroids are cut create non-uniformities of magnetic properties of the devices so that, even if the toroids were cut to precisely the specified lengths, irregularities within them would cause their magnetic properties to deviate from prescribed tolerances.

Such irregularities in the lengths of the toroids and in their magnetic properties cause inaccuracy in the phase shift effected by them; therefore, it is necessary to compensate for those irregularities. Compensation may be achieved by cutting the toroids longer than the desired length and applying a current to the aforesaid conductor which reduces the magnetization to a desired amount or by controlling the magnetizing pulse in the aforesaid conductor to preclude saturating the toroid. The compensation generally is adjusted during manufacture by means of a potentiometer connected to the electronic circuitry of each toroid so that it will provide as precisely as possible the desired phase shift. Thus each toroid requires one or two separate potentiometers which unavoidably increases the cost of the phase shifter by the cost of several potentiometers.

Another problem associated with these phase shifters is the temperature dependence of the permeability of the ferrimagnetic material from which the toroids are made. Unless the devices are kept at a specific temperature, their accuracy will vary with changes in external temperature.

According to the present invention, inexpensive pieces of permanent magnet are mounted externally of the transmission line of the phase shifter during manufacture. The permanent magnets are positioned in such a fashion that its field reduces the remanent magnetization of the toroid for either direction of magnetization. These permanent magnets adjust the magnetic fields in the toroids in such a way as to reduce the equivalent permeability. In one form of the invention, a permanent magnet is used which compensates for the effects of the aforesaid manufacturing inaccuracies at any given temperature. In another form of the invention, the permanent magnet used for this purpose has a temperature coefficient of permeability which compensates for temperature dependent changes in the permeabilities of ferrimagnetic material.

The manner in which the aforesaid permanent magnet is used will be more fully understood from the following detailed description of preferred embodiments, reference being made to the drawing in which FIG. 1 is a perspective view of a latching waveguide phase shifter according to the invention;

Figure 1:
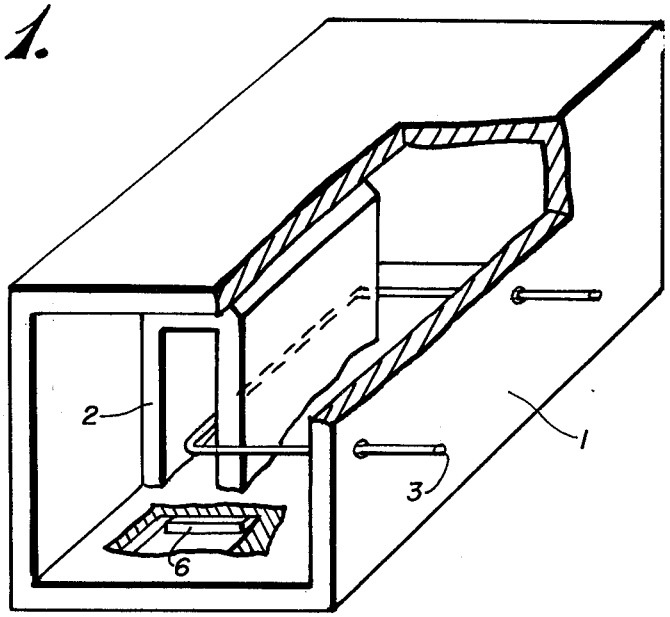
Figure 2:
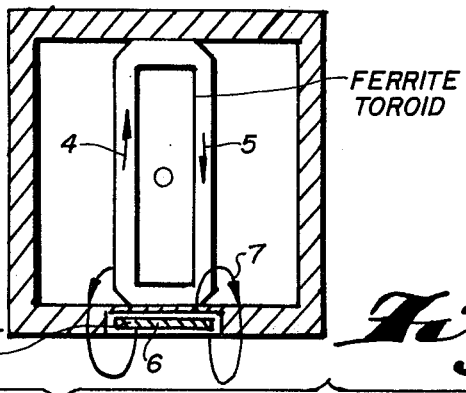
FIG. 2 is a cross section of the device.

As shown in FIG. 1, a typical waveguide phase shifter comprises a rectangular wave guide 1 having a longitudinally extending toroid 2 with a conductor 3 through its core extending longitudinally along the toroid. The direction through the toroid along the conductor 3 will be defined as the axis of the toroid. The toroid is a ferrimagnetic material having a square hysteresis loop, for example a ferrite, the selection of which is not a part of the present invention. When a magnetizing pulse flows through the conductor 3, the toroid becomes magnetized, the magnetic field being around the toroid, for example as shown in FIG. 2 by arrows 4 and 5. The direction of the magnetic field depends on the direction of the pulse along the conductor 3. When the toroid has a square hysteresis loop, a pulse in either direction along the conductor shifts the direction of magnetization around the toroid, and that magnetization is retained until another switching pulse in the opposite direction is applied.

As shown in FIG. 2, a permanent magnet 6 is provided externally of the waveguide and extending along the waveguide for a portion or all of the length of the toroid 2. The permanent magnet is positioned so that its axis of magnetization is perpendicular to the axis of the toroid, the magnetic field of the permanent magnet being shown by lines 7. consequently the magnetic field which it creates adds to the magnetic flux density B in one side of the toroid and substracts from the magnetic flux density in the other side of the toroid. Since the magnetic field is circular, the flux density in each part of the toroid cannot exceed that in the latter side of the toroid in which the permanent magnet has reduced flux density. Therefore the permanent magnet reduces magnetic flux density throughout the toroid. This is equivalent to reducing the permeability of the ferrite.

In practice the ferrite is cut to a length greater than required to achieve a desired phase shift. Then permanent magnets are applied of progressively increasing magnetic field strength or length until one is found which reduces the phase shift to the desired value.

Figure 3:
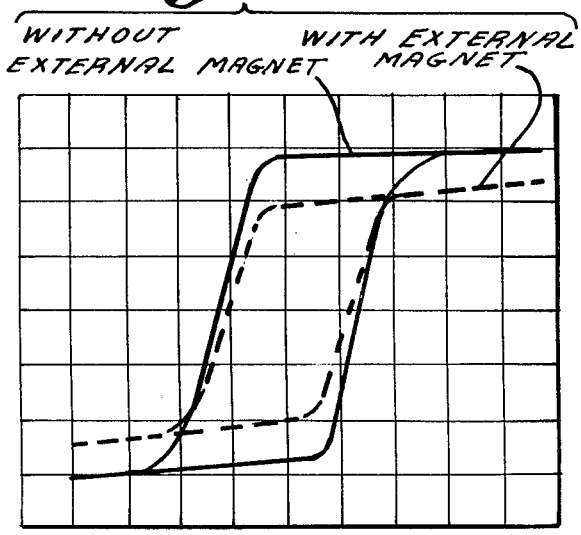
FIGS. 3 and 4 are graphs of the magnetic properties of the toroids showing the effects of the permanent magnet both at room temperature and as the temperature is changed.
Figure 4:
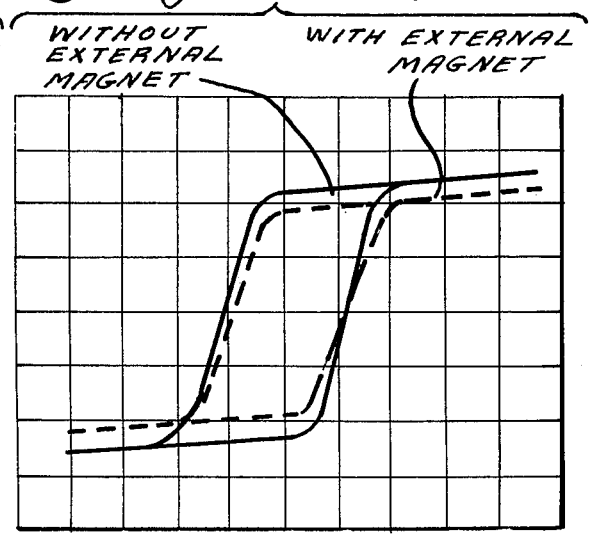

The same arrangement also achieves temperature compensation if the permanent magnet has an appropriate temperature dependence. As will be understood from the foregoing discussion, the permanent magnet's effect is to reduce the magnetic field strength B in the ferrimagnetic device. The magnetic field strength is directly proportional to the magnetic intensity H and the permeability $\mu$ in the equation $B = \mu H$. The permeability is temperature dependent, increasing as temperature decreases and decreasing as temperature increases. The field strength of the permanent magnet changes in the same way when its temperature increases and decreases. Since the permanent magnet acts in opposition to the magnetization of the ferrite, decreases and increases in the permanent magnet counteract corresponding changes in the ferrite. Ideally the permanent magnet completely compensates for the temperature dependence of the ferrite over the working temperature range, and selection of materials to achieve this effect can be accomplished by simple experiment. For instance, good results were obtained over the temperature range −20°C to +75°C on 3-1002 ferrite using a magnet of Arnox V 0.048 inch × 2.887 inch × 0.339 inch, and still better compensation was obtained when four thin pieces of Carpenter steel were laminated to the Arnox V between the Arnox V and the ferrite. The effect of the first-mentioned compensation is shown in FIGS. 3 and 4. The invention has been illustrated with a waveguide phase shifter but it will be appreciated that it is applicable to the phase shifter described in U.S. Pat. No. 3,478,283 in which case permanent magnets may be used to adjust both the longitudinal and transverse magnetic fields, each being perpendicular to the axis of the respective circular magnetic field in the double toroid described in that patent.

I claim:

1. In a phase shifter comprising a hollow metal waveguide and a ferrimagnetic toroid therein, the improvement comprising permanent magnet means, means mounting the permanent magnet means to said waveguide in a position to apply substantially equal strength parallel magnetic fields to opposite sides of said toroid in a direction perpendicular to the axis of said toroid, said magnetic fields being opposite to the direction of magnetization in one of said opposite sides and parallel to the direction of magnetization in the other side, so as to reduce the magnetization of the toroid.

2. A phase shifter as set forth in claim 1 wherein said ferrimagnetic toroid is a ferrite.

3. A phase shifter as set forth in claim 1 wherein said permanent magnet means is positioned in a recess in a wall of said waveguide.

* * * * *